US009388812B2

(12) United States Patent
Fastovets et al.

(10) Patent No.: US 9,388,812 B2
(45) Date of Patent: Jul. 12, 2016

(54) WIRELESS SENSOR SYSTEM FOR ELECTRIC SUBMERSIBLE PUMP

(71) Applicant: Schlumberger Technology Corporation, Sugar Land, TX (US)

(72) Inventors: Andrey Fastovets, Moscow (RU); William John Jack Abbott, Edmonton (CA); Jostein Engeseth Fonneland, Singapore (SG); Albert G. Ollre, Sugar Land, TX (US); Alejandro Camacho Cardenas, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 98 days.

(21) Appl. No.: 14/167,996

(22) Filed: Jan. 29, 2014

(65) Prior Publication Data

US 2015/0211526 A1 Jul. 30, 2015

(51) Int. Cl.

| | |
|---|---|
| ***F04D 13/08*** | (2006.01) |
| ***F04D 15/00*** | (2006.01) |
| ***F04D 13/10*** | (2006.01) |
| ***E21B 41/00*** | (2006.01) |
| ***E21B 43/12*** | (2006.01) |
| ***E21B 47/12*** | (2012.01) |

(52) U.S. Cl.

CPC ..... *F04D 13/08* (2013.01); *E21B 41/0085* (2013.01); *E21B 43/128* (2013.01); *E21B 47/122* (2013.01); *F04D 13/10* (2013.01); *F04D 15/0088* (2013.01)

(58) Field of Classification Search

CPC . E21B 41/0085; E21B 43/128; E21B 47/122; F04D 13/08; F04D 13/10; F04D 15/0088

See application file for complete search history.

(56) References Cited

U.S. PATENT DOCUMENTS

| | | | | |
|---|---|---|---|---|
| 5,839,508 | A | 11/1998 | Tubel et al. | |
| 6,167,965 | B1 * | 1/2001 | Bearden | E21B 43/121 166/105.5 |
| 6,840,317 | B2 | 1/2005 | Hirsch et al. | |
| 7,256,505 | B2 | 8/2007 | Arms et al. | |
| 7,286,058 | B1 | 10/2007 | Gologorsky | |
| 7,365,455 | B2 | 4/2008 | Hamel et al. | |
| 7,554,455 | B2 | 6/2009 | Gologorsky | |
| 7,777,623 | B2 | 8/2010 | Albsmeier et al. | |

(Continued)

OTHER PUBLICATIONS

International Search Report and Written Opinion issued in PCT/US2015/011743 on Apr. 22, 2015, 14 pages.

(Continued)

*Primary Examiner* — Peter J Bertheaud
*Assistant Examiner* — Dominick L Plakkoottam
(74) *Attorney, Agent, or Firm* — Michael Stonebrook

(57) ABSTRACT

An electric submersible pump system can include a shaft; a power cable connector; an electric motor configured to receive power via the power cable connector for rotatably driving the shaft; a pump operatively coupled to the shaft; a power unit for generating power via rotation of the shaft; a remote unit that includes at least one sensor for sensing information, wireless transmission circuitry for wireless transmission of sensed information and a power interface to receive power generated by the power unit; and a base unit that includes wireless reception circuitry for receipt of wireless transmission of sensed information from the remote unit and wired transmission circuitry operatively coupled to the power cable connector. Various other apparatuses, systems, methods, etc., are also disclosed.

20 Claims, 10 Drawing Sheets

(56) References Cited

U.S. PATENT DOCUMENTS

| | | | | |
|---|---|---|---|---|
| 8,009,059 | B2 | 8/2011 | Huang et al. | |
| 8,026,824 | B2 | 9/2011 | Gologorsky | |
| 8,528,395 | B2 | 9/2013 | Griffiths et al. | |
| 2003/0192692 | A1* | 10/2003 | Tubel | E21B 41/00 166/250.15 |
| 2008/0217024 | A1* | 9/2008 | Moore | E21B 4/18 166/382 |
| 2009/0044938 | A1 | 2/2009 | Crossley et al. | |
| 2010/0228502 | A1* | 9/2010 | Atherton | E21B 43/128 702/47 |
| 2012/0027630 | A1* | 2/2012 | Forsberg | E21B 43/128 417/423.3 |
| 2013/0091869 | A1 | 4/2013 | Bardon et al. | |
| 2014/0083768 | A1* | 3/2014 | Moriarty | E21B 47/122 175/40 |

OTHER PUBLICATIONS

"Fluid Coupling—Mechanical Engineering" at http://mechanicalmania.blogspot.com/2011/07/fluid-coupling.html.

"Phoenix MultiSensor xt150 — Digital Downhole monitoring system for electric submersible pumps," Schlumberger Brochure, 2011.

"Piezoelectric Energy Harvesting Kit—Piezo Bending Generator & Energy Harvesting Circuit," Piezo Systems, Inc., Catalog #8, 2011.

* cited by examiner

WIRELESS SENSOR SYSTEM FOR ELECTRIC SUBMERSIBLE PUMP

BACKGROUND

An electric submersible pump (ESP) system can include a pump driven by an electric motor. As an example, an ESP system may be deployed in a well, for example, to pump fluid. Such an ESP system may be exposed to harsh environmental and operational conditions. Knowledge of such conditions may facilitate operation of an ESP system. Various technologies, techniques, etc. described herein pertain to sensing information germane to an ESP system and transmission of such sensed information.

SUMMARY

An electric submersible pump system can include a shaft; a power cable connector; an electric motor configured to receive power via the power cable connector for rotatably driving the shaft; a pump operatively coupled to the shaft; a power unit for generating power via rotation of the shaft; a remote unit that includes at least one sensor for sensing information, wireless transmission circuitry for wireless transmission of sensed information and a power interface to receive power generated by the power unit; and a base unit that includes wireless reception circuitry for receipt of wireless transmission of sensed information from the remote unit and wired transmission circuitry operatively coupled to the power cable connector. A method can include sensing information using at least one sensor of a remote unit of an electric submersible pump system; transmitting the sensed information via wireless transmission circuitry of the remote unit; and receiving the sensed information via wireless reception circuitry of a base unit of the electric submersible pump system. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
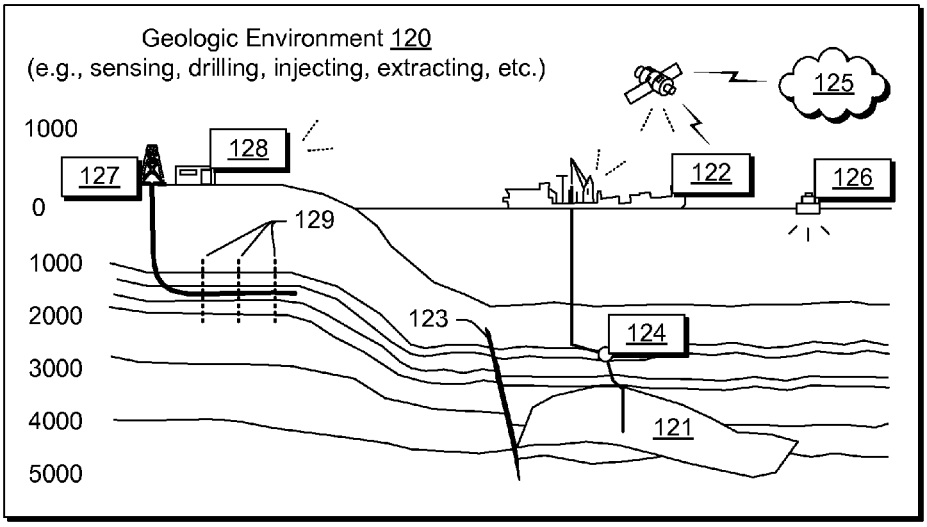
FIG. 1 illustrates examples of equipment in geologic environments.
Figure 1:
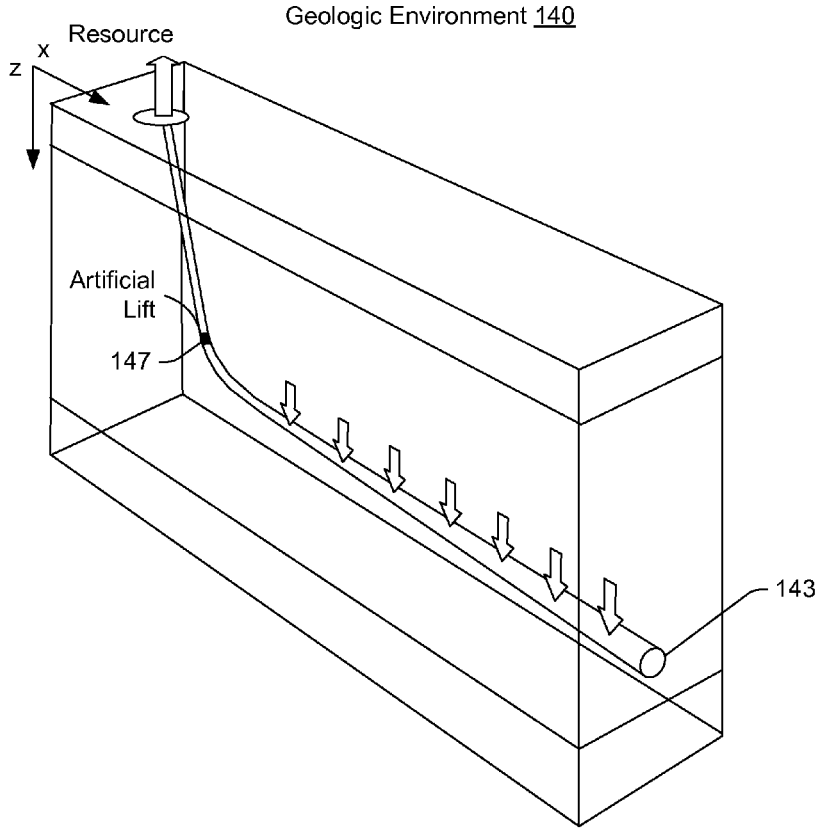

FIG. 1 shows examples of geologic environments 120 and 140. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, etc.

As to the geologic environment 140, as shown in FIG. 1, it includes a well 141 (e.g., a bore) and equipment 147 for artificial lift, which may be an electric submersible pump (e.g., an ESP). In such an example, a cable or cables may extend from surface equipment to the equipment 147, for example, to provide power, to carry information, to sense information, etc.

Conditions in a geologic environment may be transient and/or persistent. Where equipment is placed within a geologic environment, longevity of the equipment can depend on characteristics of the environment and, for example, duration of use of the equipment as well as function of the equipment. Where equipment is to endure in an environment over an extended period of time, uncertainty may arise in one or more factors that could impact integrity or expected lifetime of the equipment. As an example, where a period of time may be of the order of decades, equipment that is intended to last for such a period of time may be constructed to endure conditions imposed thereon, whether imposed by an environment or environments and/or one or more functions of the equipment itself.

Figure 2:
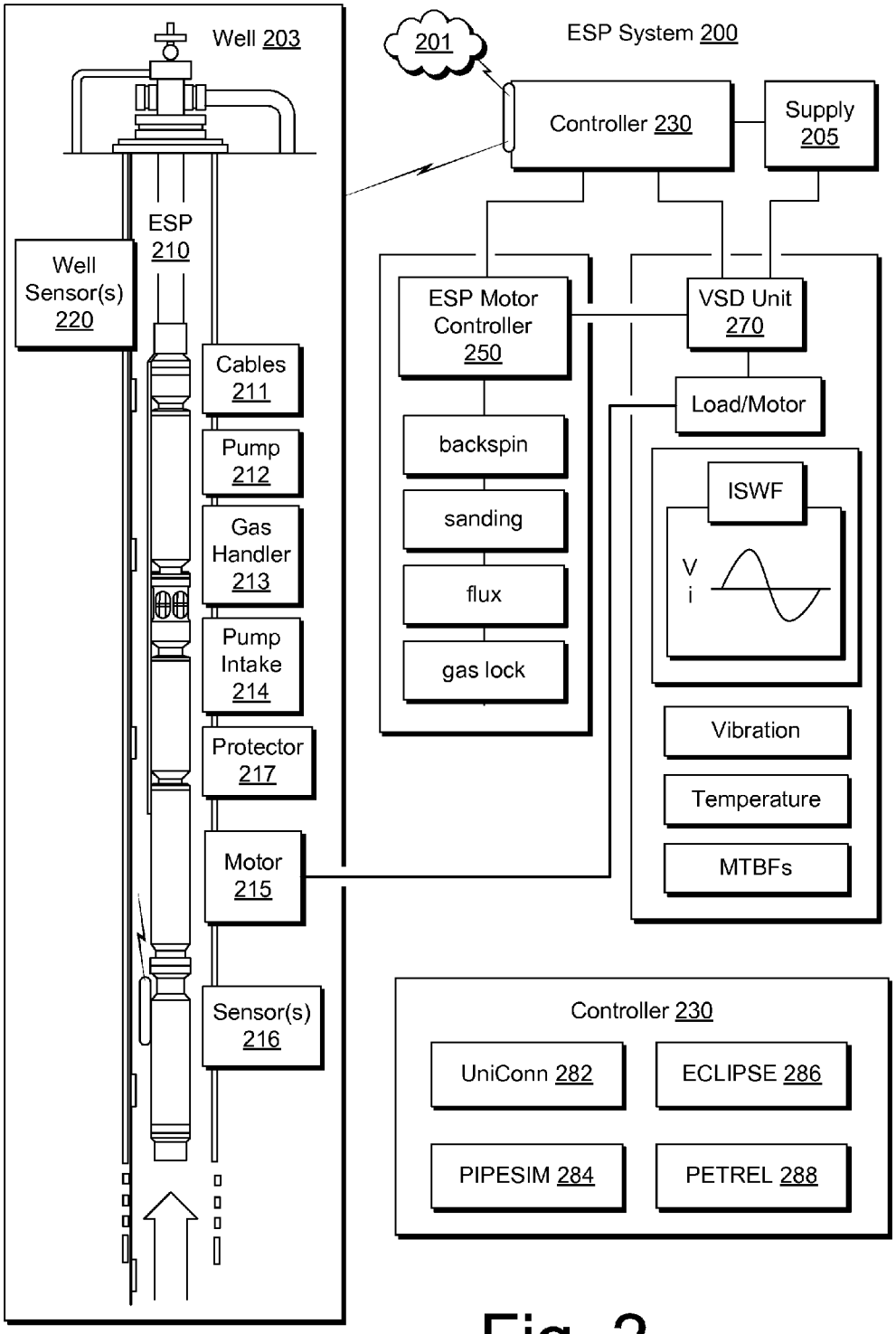
FIG. 2 illustrates an example of an electric submersible pump system.

FIG. 2 shows an example of an ESP system 200 that includes an ESP 210 as an example of equipment that may be placed in a geologic environment. As an example, an ESP may be expected to function in an environment over an extended period of time (e.g., optionally of the order of years).

In the example of FIG. 2, the ESP system 200 includes a network 201, a well 203 disposed in a geologic environment (e.g., with surface equipment, etc.), a power supply 205, the ESP 210, a controller 230, a motor controller 250 and a VSD unit 270. The power supply 205 may receive power from a power grid, an onsite generator (e.g., natural gas driven turbine), or other source. The power supply 205 may supply a voltage, for example, of about 4.16 kV.

As shown, the well 203 includes a wellhead that can include a choke (e.g., a choke valve). For example, the well 203 can include a choke valve to control various operations such as to reduce pressure of a fluid from high pressure in a closed wellbore to atmospheric pressure. A wellhead may include one or more sensors such as a temperature sensor, a pressure sensor, a solids sensor, etc.

As to the ESP 210, it is shown as including cables 211 (e.g., or a cable), a pump 212, gas handling features 213, a pump intake 214, a motor 215, one or more sensors 216 (e.g., temperature, pressure, strain, current leakage, vibration, etc.) and a protector 217.

As an example, an ESP may include a REDA™ Hotline high-temperature ESP motor. Such a motor may be suitable for implementation in a thermal recovery heavy oil production system, such as, for example, SAGD system or other steam-flooding system.

As an example, an ESP motor can include a three-phase squirrel cage with two-pole induction. As an example, an ESP motor may include steel stator laminations that can help focus magnetic forces on rotors, for example, to help reduce energy loss. As an example, stator windings can include copper and insulation.

As an example, the one or more sensors 216 of the ESP 210 may be part of a digital downhole monitoring system. For example, consider the commercially available Phoenix™ Multisensor xt150 system marketed by Schlumberger Limited (Houston, Tex.). A monitoring system may include a base unit that operatively couples to an ESP motor (see, e.g., the motor 215), for example, directly, via a motor-base crossover, etc. As an example, such a base unit (e.g., base gauge) may measure intake pressure, intake temperature, motor oil temperature, motor winding temperature, vibration, currently leakage, etc. As explained with respect to FIG. 4, a base unit may transmit information via a power cable that provides power to an ESP motor and may receive power via such a cable as well.

As an example, a remote unit may be provided that may be located at a pump discharge (e.g., located at an end opposite the pump intake 214). As an example, a base unit and a remote unit may, in combination, measure intake and discharge pressures across a pump (see, e.g., the pump 212), for example, for analysis of a pump curve. As an example, alarms may be set for one or more parameters (e.g., measurements, parameters based on measurements, etc.).

Where a system includes a base unit and a remote unit, such as those of the Phoenix™ Multisensor x150 system, the units may be linked via wires. Such an arrangement provide power from the base unit to the remote unit and allows for communication between the base unit and the remote unit (e.g., at least transmission of information from the remote unit to the base unit). As an example, a remote unit is powered via a wired interface to a base unit such that one or more sensors of the remote unit can sense physical phenomena. In such an example, the remote unit can then transmit sensed information to the base unit, which, in turn, may transmit such information to a surface unit via a power cable configured to provide power to an ESP motor.

Where a remote unit and a base unit are coupled via wires, damage to the wires can result in loss of functionality of the remote unit. As an example, a system may be provided with wireless communication technology for at least transmission of information from a remote unit to a base unit (e.g., or to another remote unit). As an example, such wireless communication technology may be provided optionally in addition to one or more wires between a base unit and at least one remote unit. As an example, wireless communication technology may be selectable for use, used where a wire is damaged, etc.

As an example, a wireless remote ESP sensor unit may be installed in or on an ESP string to monitor one or more pump operational parameters (e.g., pressure, temperature, vibration, flow, shaft strain and torque, etc.) and transmit information wirelessly to a base unit and/or another remote unit. As an example, a remote unit may be powered by electrical energy generated from a rotating ESP shaft. As an example, a base unit may be deployed below an ESP motor and powered, for example, via a wye point connection. As an example, a remote unit may be integrated into one or more ESP components (e.g., a component housing, etc.), which may help minimize a number of on-site connections (e.g., and optionally maintain an outer profile of an ESP). As an example, a system may include an energy storage device such as, for example, a battery, a flywheel, one or more capacitors (e.g., optionally super-capacitors), etc. As an example, a storage device may be configured to provide power to at least a remote unit where an energy generation unit may generate insufficient energy (e.g., where an ESP shaft may be stationary).

As an example, where wireless technology is employed (e.g., for interoperation between a base unit and a remote unit), an ESP system may optionally be configured with a smaller overall system OD, simplified installation and improved reliability (e.g., because risk of physically damaging wires while RIH or operation may be avoided).

In the example of FIG. 2, the well 203 may include one or more well sensors 220, for example, such as the commercially available OpticLine™ sensors or WellWatcher BriteBlue™ sensors marketed by Schlumberger Limited (Houston, Tex.). Such sensors are fiber-optic based and can provide for real time sensing of temperature, for example, in SAGD or other operations. As shown in the example of FIG. 1, a well can include a relatively horizontal portion. Such a portion may collect heated heavy oil responsive to steam injection. Measurements of temperature along the length of the well can provide for feedback, for example, to understand conditions downhole of an ESP. Well sensors may extend thousands of feet into a well (e.g., 4,000 feet or more) and beyond a position of an ESP.

In the example of FIG. 2, the controller 230 can include one or more interfaces, for example, for receipt, transmission or receipt and transmission of information with the motor controller 250, a VSD unit 270, the power supply 205 (e.g., a gas fueled turbine generator, a power company, etc.), the network 201, equipment in the well 203, equipment in another well, etc.

As shown in FIG. 2, the controller 230 may include or provide access to one or more modules or frameworks. Further, the controller 230 may include features of an ESP motor controller and optionally supplant the ESP motor controller 250. For example, the controller 230 may include the UniConn™ motor controller 282 marketed by Schlumberger Limited (Houston, Tex.). In the example of FIG. 2, the controller 230 may access one or more of the PIPESIM™ framework 284, the ECLIPSE™ framework 286 marketed by Schlumberger Limited (Houston, Tex.) and the PETREL™ framework 288 marketed by Schlumberger Limited (Houston, Tex.) (e.g., and optionally the OCEAN™ framework marketed by Schlumberger Limited (Houston, Tex.)).

In the example of FIG. 2, the motor controller 250 may be a commercially available motor controller such as the UniConn™ motor controller. The UniConn™ motor controller can connect to a SCADA system, the espWatcher™ surveillance system, etc. The UniConn™ motor controller can perform some control and data acquisition tasks for ESPs, surface pumps or other monitored wells. As an example, the UniConn™ motor controller can interface with the aforementioned Phoenix™ monitoring system, for example, to access pressure, temperature and vibration data and various protection parameters as well as to provide direct current power to downhole sensors. The UniConn™ motor controller can interface with fixed speed drive (FSD) controllers or a VSD unit, for example, such as the VSD unit 270.

For FSD controllers, the UniConn™ motor controller can monitor ESP system three-phase currents, three-phase surface voltage, supply voltage and frequency, ESP spinning frequency and leg ground, power factor and motor load.

For VSD units, the UniConn™ motor controller can monitor VSD output current, ESP running current, VSD output voltage, supply voltage, VSD input and VSD output power, VSD output frequency, drive loading, motor load, three-phase ESP running current, three-phase VSD input or output voltage, ESP spinning frequency, and leg-ground.

In the example of FIG. 2, the ESP motor controller 250 includes various modules to handle, for example, backspin of an ESP, sanding of an ESP, flux of an ESP and gas lock of an ESP. The motor controller 250 may include any of a variety of features, additionally, alternatively, etc.

In the example of FIG. 2, the VSD unit 270 may be a low voltage drive (VSD) unit, a medium voltage drive (MVD) unit or other type of unit (e.g., a high voltage drive, which may provide a voltage in excess of about 4.16 kV). As an example, the VSD unit 270 may receive power with a voltage of about 4.16 kV and control a motor as a load with a voltage from about 0 V to about 4.16 kV. The VSD unit 270 may include commercially available control circuitry such as the SpeedStar™ MVD control circuitry marketed by Schlumberger Limited (Houston, Tex.).

Figure 3:
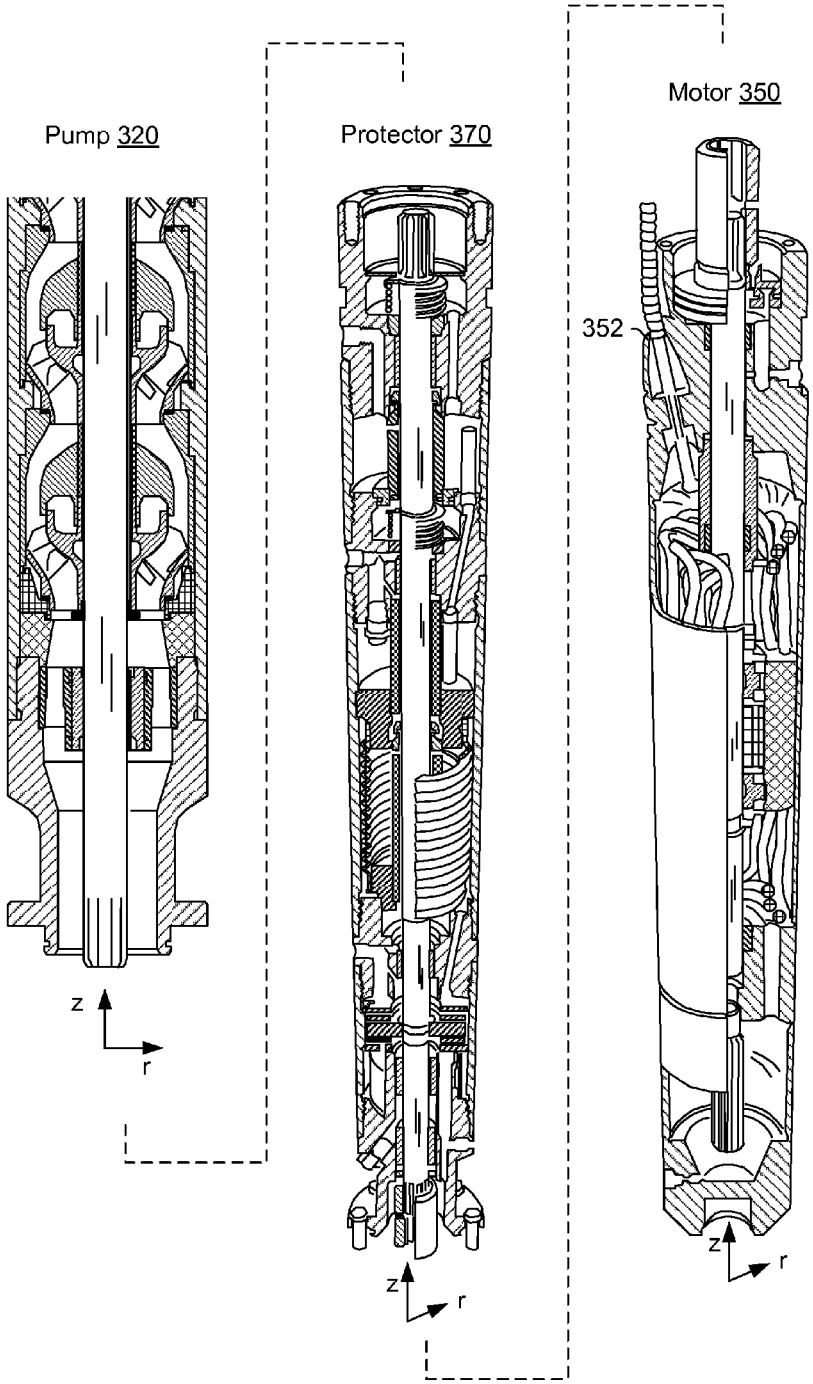
FIG. 3 illustrates examples of equipment.

FIG. 3 shows cut-away views of examples of equipment such as, for example, a portion of a pump 320, a protector 370 and a motor 350 of an ESP. The pump 320, the protector 370 and the motor 350 are shown with respect to cylindrical coordinate systems (e.g., r, z, Θ). Various features of equipment may be described, defined, etc. with respect to a cylindrical coordinate system. As an example, a lower end of the pump 320 may be coupled to an upper end of the protector 370 and a lower end of the protector 370 may be coupled to an upper end of the motor 350. As shown in FIG. 3, a shaft segment of the pump 320 may be coupled via a connector to a shaft segment of the protector 370 and the shaft segment of the protector 370 may be coupled via a connector to a shaft segment of the motor 350. As an example, an ESP may be oriented in a desired direction, which may be vertical, horizontal or other angle. As shown in FIG. 3, the motor 350 is an electric motor that includes a connector 352, for example, to operatively couple the electric motor to a power cable, for example, optionally via one or more motor lead extensions (see, e.g., FIG. 4).

Figure 4:
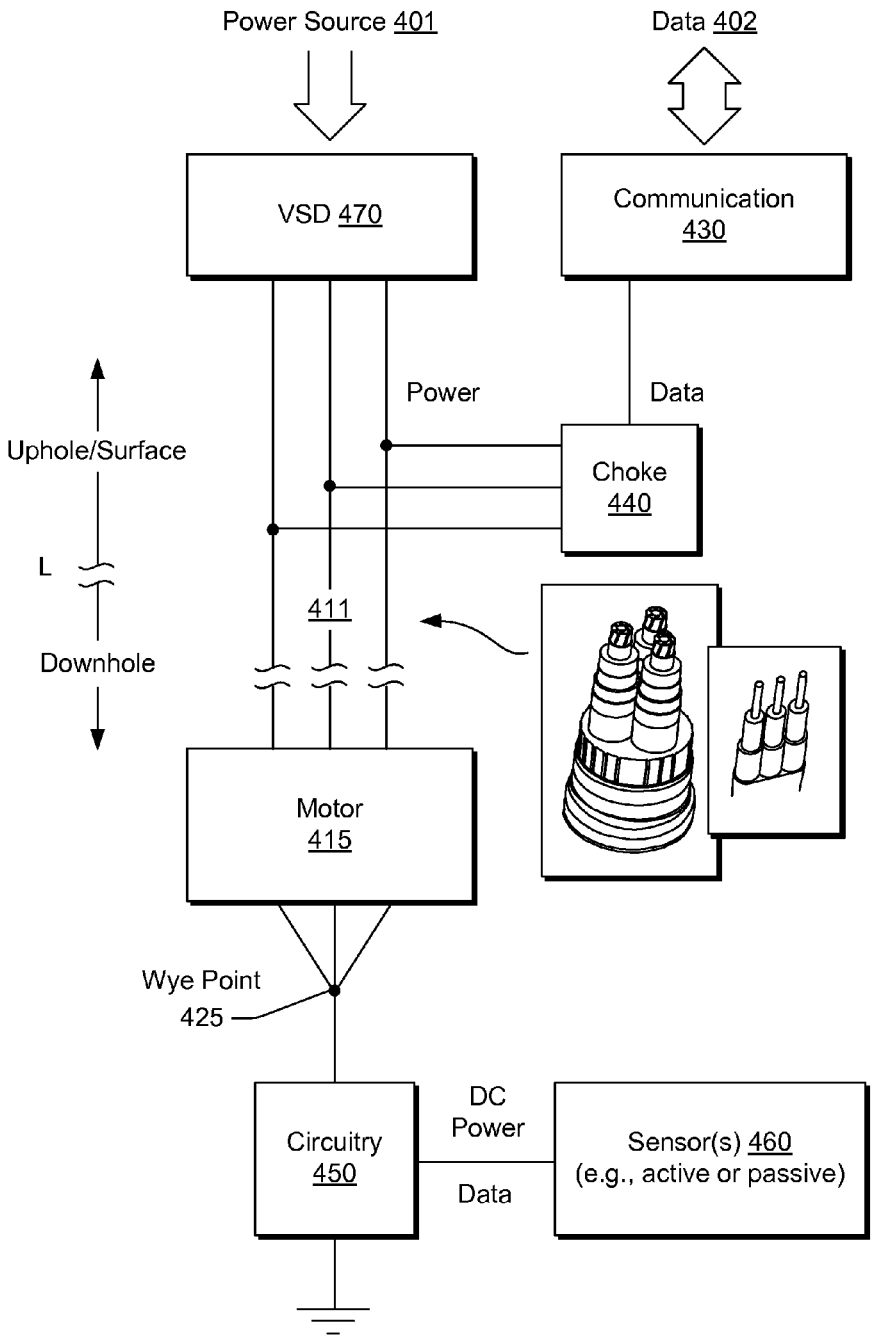
FIG. 4 illustrates an example of a system that includes a motor.

FIG. 4 shows a block diagram of an example of a system 400 that includes a power source 401 as well as data 402 (e.g., information). The power source 401 provides power to a VSD block 470 while the data 402 may be provided to a communication block 430. The data 402 may include instructions, for example, to instruct circuitry of the circuitry block 450, one or more sensors of the sensor block 460, etc. The data 402 may be or include data communicated, for example, from the circuitry block 450, the sensor block 460, etc. In the example of FIG. 4, a choke block 440 can provide for transmission of data signals via a power cable 411 (e.g., including motor lead extensions "MLEs"). A power cable may be provided in a format such as a round format or a flat format with multiple conductors. MLEs may be spliced onto a power cable to allow each of the conductors to physically connect to an appropriate corresponding connector of an electric motor (see, e.g., the connector 352 of FIG. 3). As an example, MLEs may be bundled within an outer casing (e.g., a layer of armor, etc.).

As shown, the power cable 411 connects to a motor block 415, which may be a motor (or motors) of an ESP and be controllable via the VSD block 470. In the example of FIG. 4, the conductors of the power cable 411 electrically connect at a wye point 425. The circuitry block 450 may derive power via the wye point 425 and may optionally transmit, receive or transmit and receive data via the wye point 425. As shown, the circuitry block 450 may be grounded.

As an example, power cables and MLEs that can resist damaging forces, whether mechanical, electrical or chemical, may help ensure proper operation of a motor, circuitry, sensors, etc.; noting that a faulty power cable (or MLE) can potentially damage a motor, circuitry, sensors, etc. Further, as mentioned, an ESP may be located several kilometers into a wellbore. Accordingly, time and cost to replace a faulty ESP, power cable, MLE, etc., can be substantial (e.g., time to withdraw, downtime for fluid pumping, time to insert, etc.).

Figure 5:
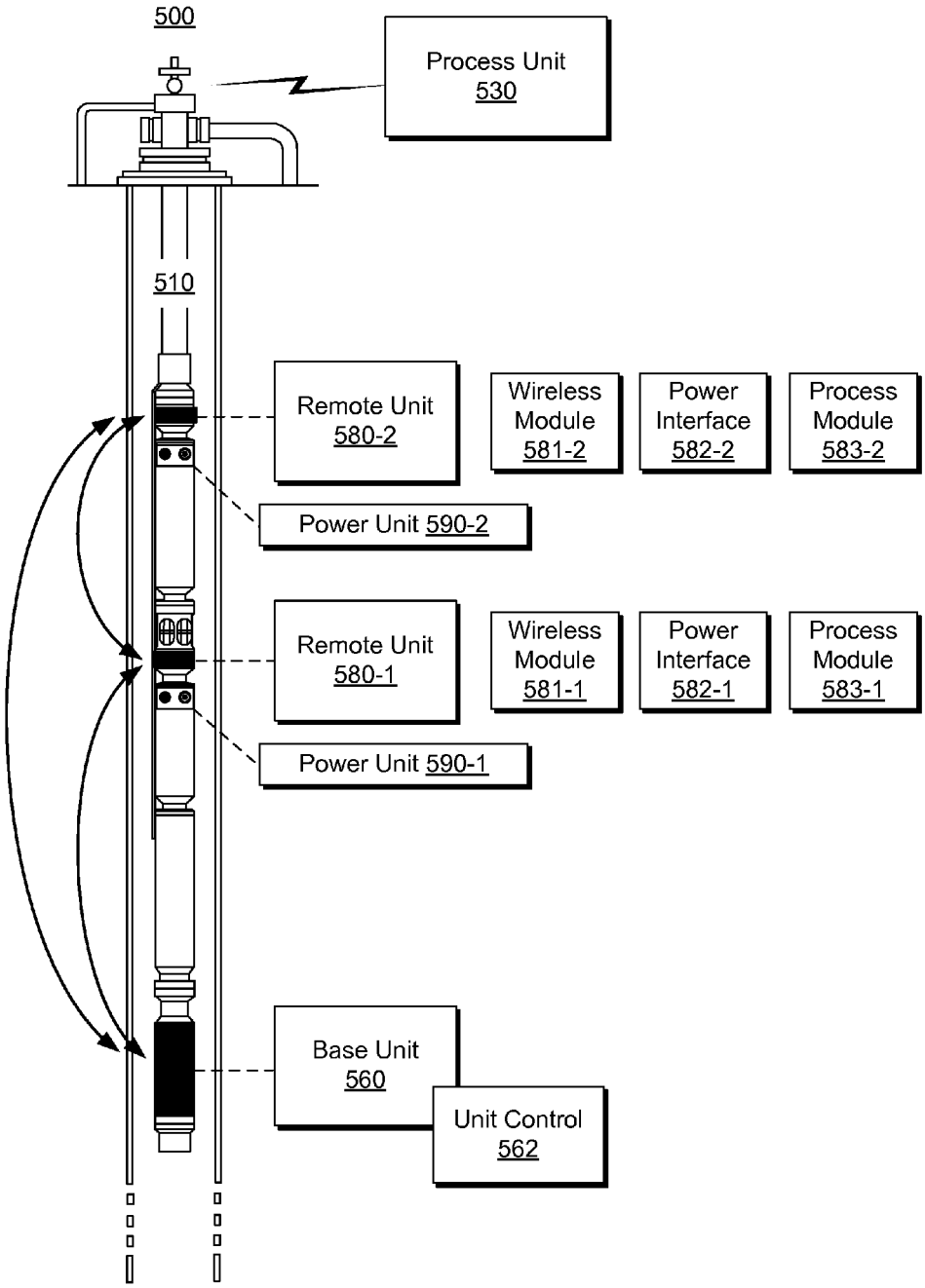
FIG. 5 illustrates an example of a system that includes sensors.

FIG. 5 shows an example of a system 500 that includes an ESP system 510 and a process unit 530, which may provide for control, analysis of information, etc. As shown in the example of FIG. 5, the ESP system 510 includes a base unit 560 with a unit control module 562, one or more remote units 580-1 and 580-2 and one or more power units 590-1 and 590-2. As an example, a power unit may be part of a remote unit. For example, a unit may include circuitry to perform various functions where such circuitry is powered, directly or indirectly, by a power generator.

As an example, the remote unit 580-1 may include a wireless module 581-1, a power interface 582-1 and a process module 583-1. As an example, the remote unit 580-2 may include a wireless module 581-2, a power interface 582-2 and a process module 583-2. In the example of FIG. 5, the power unit 590-1 may provide power to the remote unit 580-1 via the power interface 582-1 and the power unit 590-2 may provide power to the remote unit 580-2 via the power interface 582-2.

As an example, the unit control module 562 of the base unit 560 may include circuitry, processor executable instructions, etc. for performing control tasks associated with the one or more remote units 580-1 and 580-2. For example, the unit control module 562 may provide for arbitration of information transmission, which may include transmission of measured values, commands, etc. As an example, the unit control module 562 may arbitrate transmissions, for example, deciding when and/or how to transmit information to the process unit 530 (e.g., via an ESP motor power cable).

As an example, the unit control module 562 may monitor power status of the one or more remote units 580-1 and 580-2, for example, to determine a transmission schedule, a sensing schedule, etc. In such an example, where a remote unit may be low on power (e.g., due to lack of supply by a power unit, due to a power storage device being depleted, etc.), the unit control module 562 may reduce demand (e.g., load) of the remote unit. Further, where power level changes to a higher level, the unit control module 562 may adjust demand (e.g., load) of the remote unit. For example, where ample power is available, the unit control module 562 may call for more frequent sensing, more accurate sensing (e.g., more samples, higher bit depth, etc.).

As an example, the unit control module 562 may make decisions based at least in part on sensed information, whether from the base unit 560 or one or more of the one or more remote units 580-1 and 580-2. As an example, a remote unit may include unit control circuitry, for example, that may provide for control of one or more remote units. In such an example, a master remote unit may implement one or more control schemes for another remote unit (e.g., master-slave arrangement). As an example, a remote unit that is physically positioned closest to a base unit may be configured to be a master remote unit with respect to one or more other remote units that are physically positioned further away from the base unit. For example, the remote unit 580-1 may be a master remote unit while the remote unit 580-2 may be a slave remote unit. In such an example, transmission of information from the remote unit 580-2 may occur via the remote unit 580-1 (e.g., in daisy-chain manner). Such an approach may provide for increased signal-to-noise for transmission of information to and/or from the remote unit 580-2 (e.g., with respect to the base unit 560).

As to the wireless modules 581-1 and 581-2, the base unit 560 may include corresponding circuitry. As an example, wireless transmission may occur according to a wireless transmission standard. As an example, wireless transmission may occur via a medium or media that is in an annular space between an ESP system and a wall (e.g., of completion equipment, tubing, a borehole, etc.). While FIG. 5 shows arrows extending outside of the completion wall, as an example, transmission of information may occur within the bounds of the completion wall (e.g., within a medium or media disposed between the units 560, 580-1 and 580-2).

As an example, a system may provide for monitoring operational parameters of an ESP system in multiple points along an ESP system string. As shown in the example of FIG. 5, particular locations may include intake and discharge locations of a pump. As an example, a system may include one or more pump to pump connections. For example, a system may include multiple ESPs.

As an example, a remote unit (e.g., a remote sensor unit) may include an associated power generation unit and a wireless communication module, for example, in to sensor electronics. Such a remote unit may be implemented, for example, without a dedicated cable(s), connector(s), etc. to a base unit. In such an example, a base unit may include a communication module to receive/transmit data from/to the remote unit. As an example, a base unit may be configured with circuitry to communicate bi-directionally and optionally simultaneously (e.g., using multiplexing technology or other technology) with a number of remote units. As an example, a system may include a remote unit installed between each pump section in an installation that includes multiple pump sections.

As an example, frequency division multiplexing, time division multiplexing and/or other multiplexing may optionally be implemented for transfer of information between units. As an example, code division multiplexing may be implemented. As an example, wireless communication may be implemented using analog and/or digital communication technologies. As an example, modulation may be employed for transmission of information and, for example, demodulation may be employed for receipt of information. As an example, modulation may include one or more of analog and digital modulation. As an example, modulation may include varying one or more properties of a waveform (e.g., a carrier signal) using a modulating signal or signals. As an example, information may be represented as a modulated signal or signals, which, in turn, may be demodulated. As an example, communication circuitry (e.g., a communication module) may include a signal generator and modulation circuitry to module a generated signal and/or demodulation circuitry. As an example, communication circuitry may include one or more antennas, which may be configured for transmission and/or receipt of signals.

As an example, communication circuitry may be configured for communication in a radio frequency (RF) or other frequency band or bands. As an example, circuitry may be provided that may adjust a communication technique, for example, via mode switching, etc. For example, circuitry may determine quality (quality of signal) and implement an algorithm to determine whether quality may be improved. Where quality may be improved, for example, by a desirable amount, such circuitry may adjust one or more communication parameters (e.g., carrier frequency, etc.). Such an approach may be implemented, for example, where a medium or media through which a signal is transmitted changes (e.g., consider media in an annular space about an ESP). As an example, a method may include one or more of hopping and shifting, for example, to maintain a communication link and/or to improve a communication link. As an example, a sensor or sensors may sense one or more characteristics of a medium or media (e.g., one or more dielectric properties). In such an example, sensed information may be used to maintain and/or improve communication (e.g., with respect to one or more remote units). As an example, circuitry may respond to one or more sensed condition, for example, as to intake and discharge of a pump or pumps, which may indicate that one or more characteristics of a medium or media in a region through which signals are carried may have changed, for example, which may impact signal quality. For example, consider a change as to one or more of gas content, water content, hydrocarbon content, etc. of media (e.g., multiphase media) through which signals are carried. In such an example, sensed information may be germane to ESP operation and/or to communication (e.g., quality of communication, etc.).

As an example, wireless technology may provide for transmission for a specified distance, for example, to provide for transmissions between units of a system in a particular environment. As an example, remote units may be "daisy-chained" wirelessly, for example, to amplify signal (e.g., with respect to noise) and transfer to/from adjacent remote units (e.g., to enhance reliability). As an example, bi-directional communication between a base unit and one or more remote units may provide for change of settings, different sampling rates and controlling other operational parameters of the one or more remote units.

As an example, one or more internal components of a remote unit may be packaged in a short pump housing with a flange and shaft connections, which may provide for a more simplified equipment design, for example, as to on-site connections, etc.

As an example, a power unit and a remote unit may utilize limited space, for example, internally in a housing and in a manner positioned as to minimize restriction to flow of produced fluid. As an example, a discharge remote unit (e.g., a remote unit including one or more sensors for sensing information at a discharge of a pump) may be configured with short shaft that extends to reach a power unit, which may, for example, maximize area for fluid flow. As an example, a bearing system may be included in a pump to support and stabilize a shaft inside a housing. In such an example, a power unit may be located adjacent to or proximate to the bearing system.

As an example, a power unit may be implemented that is configured to convert rotational energy of a shaft to electrical energy, for example, to power sensor electronics and communication module (e.g., of a remote unit). As an example, a brushless AC generator (e.g., an alternator) may be employed. As an example, an arrangement may include strong rare-earth magnets affixed to a shaft forming N and S poles and creating an AC signal in stationary coils affixed to the pump/sensor housing. In such an example, the resulting signal may be rectified and conditioned as appropriate to provide power to one or more electronic components (e.g., operational circuitry, storage device(s), etc.).

As an example, a power unit may include induction generator circuitry, which may operate without use of rare-earth magnets and, for example, provide for higher temperature ceiling. As an example, an induction generator may be configured as a "squirrel cage" and operated similar to an ESP motor but in a reverse manner as a generator.

As mentioned, a system may include a power storage device. For example, a power unit, a remote unit, a storage unit, etc. may include a battery, a capacitor (e.g., super capacitor), a compact flywheel (e.g., kinetic energy storage device), etc. Such a storage device may allow a remote unit to operate for a period of time after an ESP is switched off and the shaft is not rotating. For example, where power drops below a level for reliable transmission, sensed information may still be acquired and stored in memory (e.g., NVRAM, etc.) internal to a remote unit, for example, for transmission when an appropriate level of power becomes available.

As an example, a power unit may be configured such that rotational movement can be harvested directly from a shaft via a generator rotor (e.g., permanent magnet, squirrel cage, etc.) mechanically attached to the shaft. As an example, a shaft may be hydraulically coupled to a generator rotor via an intermediate low-drag fluid coupler (e.g., a hydraulic power unit). As an example, a hydraulic power unit may optionally be positioned within motor oil (e.g., in a protector or in a motor). As an example, a power unit (e.g., electrical alternator or inductor) may be located at or proximate to an end of a shaft. Such an approach may facilitate better tolerance of rotational speed transients (e.g., start, stops, rpm changes) for smoother operation. As an example, a fluid coupling may allow for implementation of a flywheel for power storage (e.g., kinetic energy storage). As an example, piezo-electric energy harvesting circuitry may be implemented, for example, a piezoceramic transducer may be stressed mechanically by a force (e.g., due to a component, fluid flow, fluid pressure, etc.) such that its electrodes receive a charge that tends to counteract imposed strain. In such an example, the charge may be, for example, collected, stored and/or delivered to power electrical circuitry.

Figure 6:
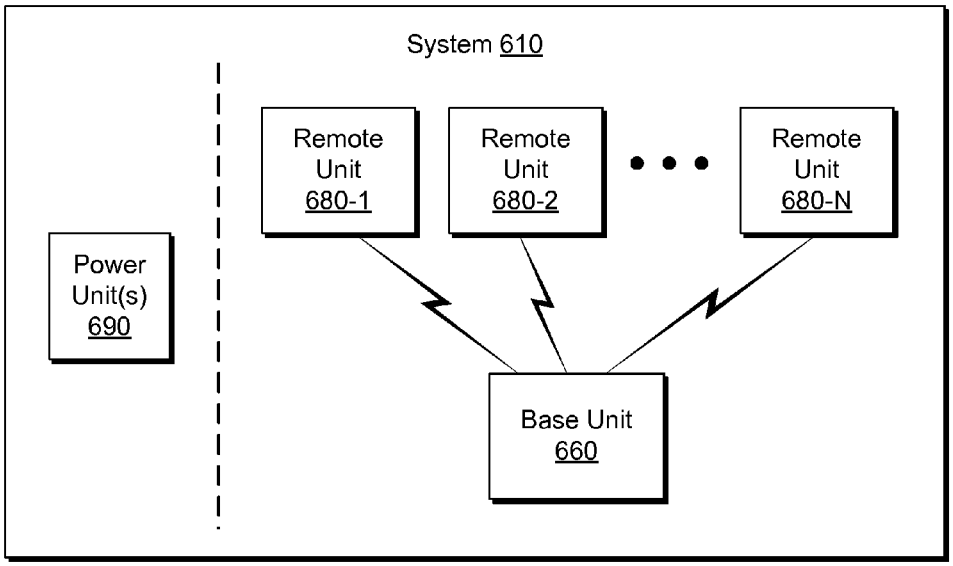
FIG. 6 illustrates an example of a system and an example of a method.
Figure 6:
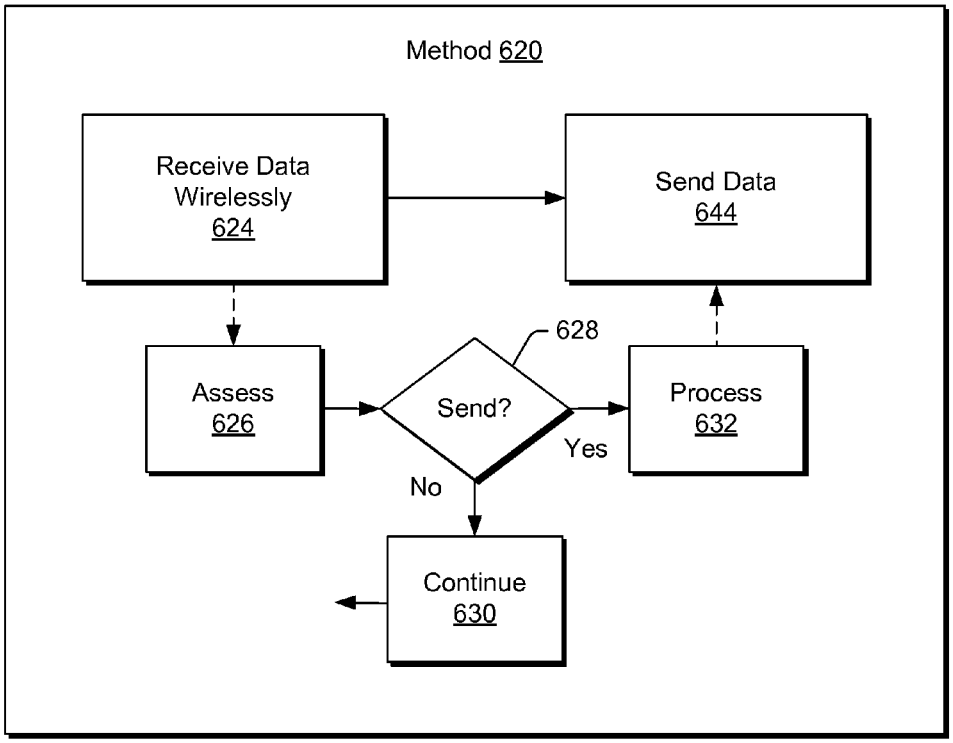

FIG. 6 shows an example of a system 610 and an example of a method. As shown, the system 610 includes a base unit 660, one or more remote units 680 and at least one power unit 690. The method 620 includes a reception block 624 for receiving data wirelessly and a send block 644 for sending data, for example, via a wire to a surface unit, etc. As shown, the method 620 may include an assessment block 626 for assessing data, a decision block 628 for deciding whether to send the data based at least in part on an assessment of the data, a process block 632 for processing the data prior to sending via the send block 644 where the decision block 628 has decided that the data is to be sent and a continuation block 630, for example, to continue operation without sending the data, for example, based on a decision not to send the data per the decision block 628. In such an example, the process block 632 may process the data via a compression or other technique, for example, to minimize bandwidth, time, etc. for sending the data. As an example, the assessment block 626 may include assessing the data with respect to one or more criteria, for example, a limit, an alarm, a standard deviation of measurements, etc. For example, if a series of measurements are assessed statistically by the assessment block 626 and the statistics indicate that the measurements do not meet one or more criteria per the decision block 628, the decision block 628 may decide not to send the assessed data.

Figure 7:
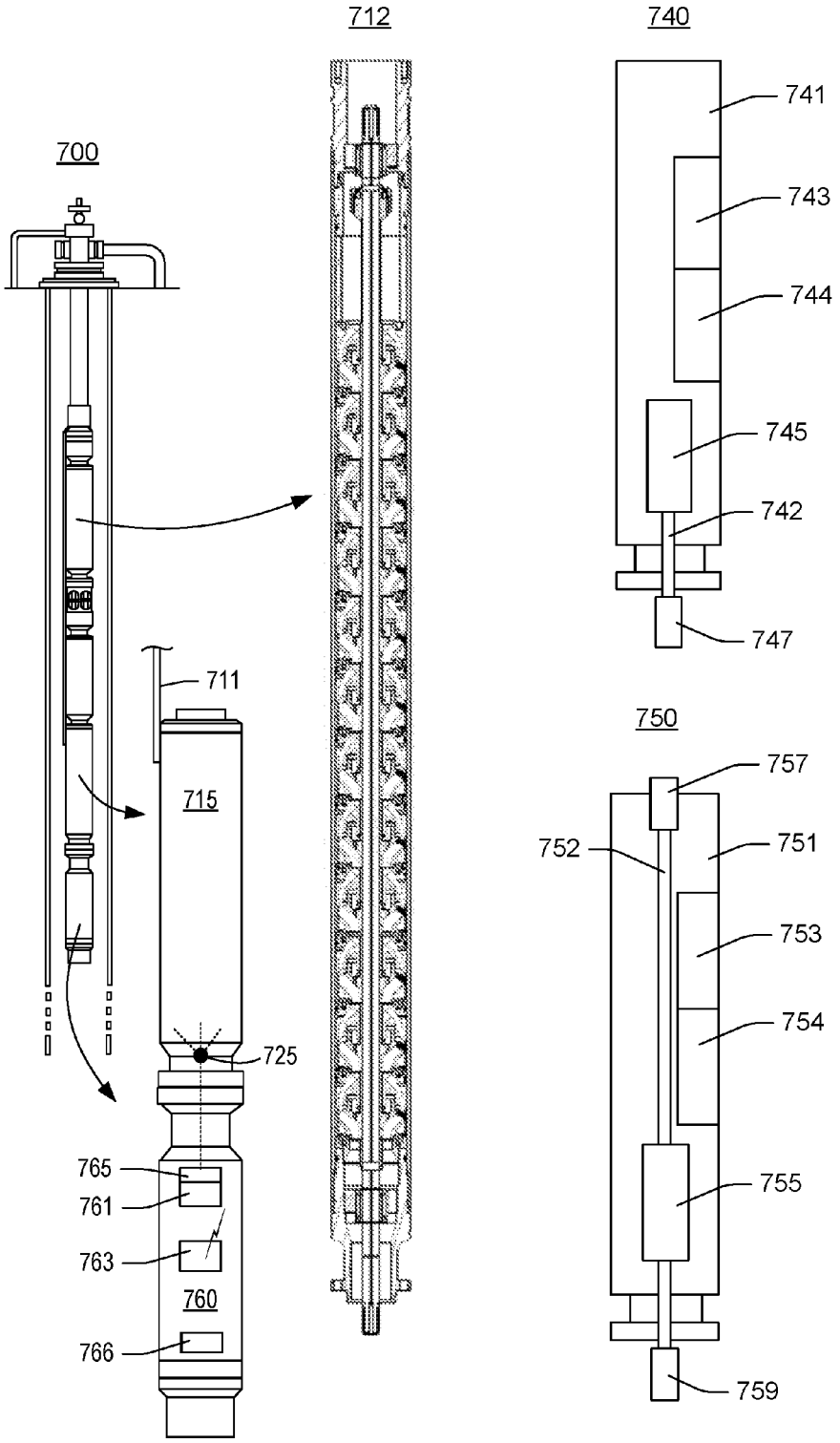
FIG. 7 illustrates examples of systems.

FIG. 7 shows an example of a system 700 that includes a pump section 712. FIG. 7 also shows an example of a pump section 740 and an example of a pump section 750. As an example, a system may include multiple pump sections. For example, the pump section 740 may be a terminal pump section that includes a pump housing 741, a shaft 742, a communications module 743, a sensor module 744 operatively coupled to the communications module 743, and a power generation module 745 that can generate power via rotation of the shaft 742. As shown, the shaft 742 includes a coupling 747 for coupling the shaft 742 to another shaft, for example, that is part of another pump section, etc.

As to the pump section 750, it includes a housing 751, a shaft 752, a communications module 753, a sensor module 754 operatively coupled to the communications module 753, and a power generation module 755 that can generate power via rotation of the shaft 752. As shown, the shaft 752 includes a coupling 757 and a coupling 759. As an example, the pump section 750 may be an intermediate pump section that may be disposed adjacent to another pump section or that may be disposed between two pump sections. For example, the coupling 757 may couple to a pump section such as the pump section 740 and the coupling 759 may couple to a protector or another pump section (e.g., such as the pump section 750).

As an example, a system may include one or more of the pump sections 740 and 750. As an example, a system may include the pump section 740 mounted to the pump section 750 where, for example, a motor may drive the shaft 742 via the shaft 752. In such an example, a protector may be mounted between the motor and the pump section 750.

As an example, a system may include multiple pump sections where each of the pump sections includes a communications module. In such a system, the communications modules may be daisy-chained. For example, a communications module of a terminal pump section may communicate with a communications module of an intermediate pump section, which may, in turn, communicate with a communications module of a base unit (e.g., a gauge), which may be mounted to a motor section. In the example of FIG. 7, the system 700 is a string of components (e.g., an ESP system string) where a cable 711 is operatively coupled to a motor section 715 that is operatively coupled to a base unit 760 (e.g., a gauge) where the base unit includes wired transmission circuitry 761 (e.g., operatively coupled to a wye point 725 of the motor section 715), wireless reception circuitry 763, power reception circuitry 765 (e.g., operatively coupled to the wye point 725 of the motor section 715) and at least one sensor 766.

As an example, a terminal pump section may be an uppermost pump section that may include a sensor for sensing information such as, for example, discharge pressure and optionally one or more other physical phenomena (e.g., temperature, flow rate, etc.). Such information may be communicated to a base unit (e.g., a gauge), directly or indirectly, where, for example, it may be analyzed in conjunction with other sensed information (e.g., intake pressure, etc.).

Figure 8:
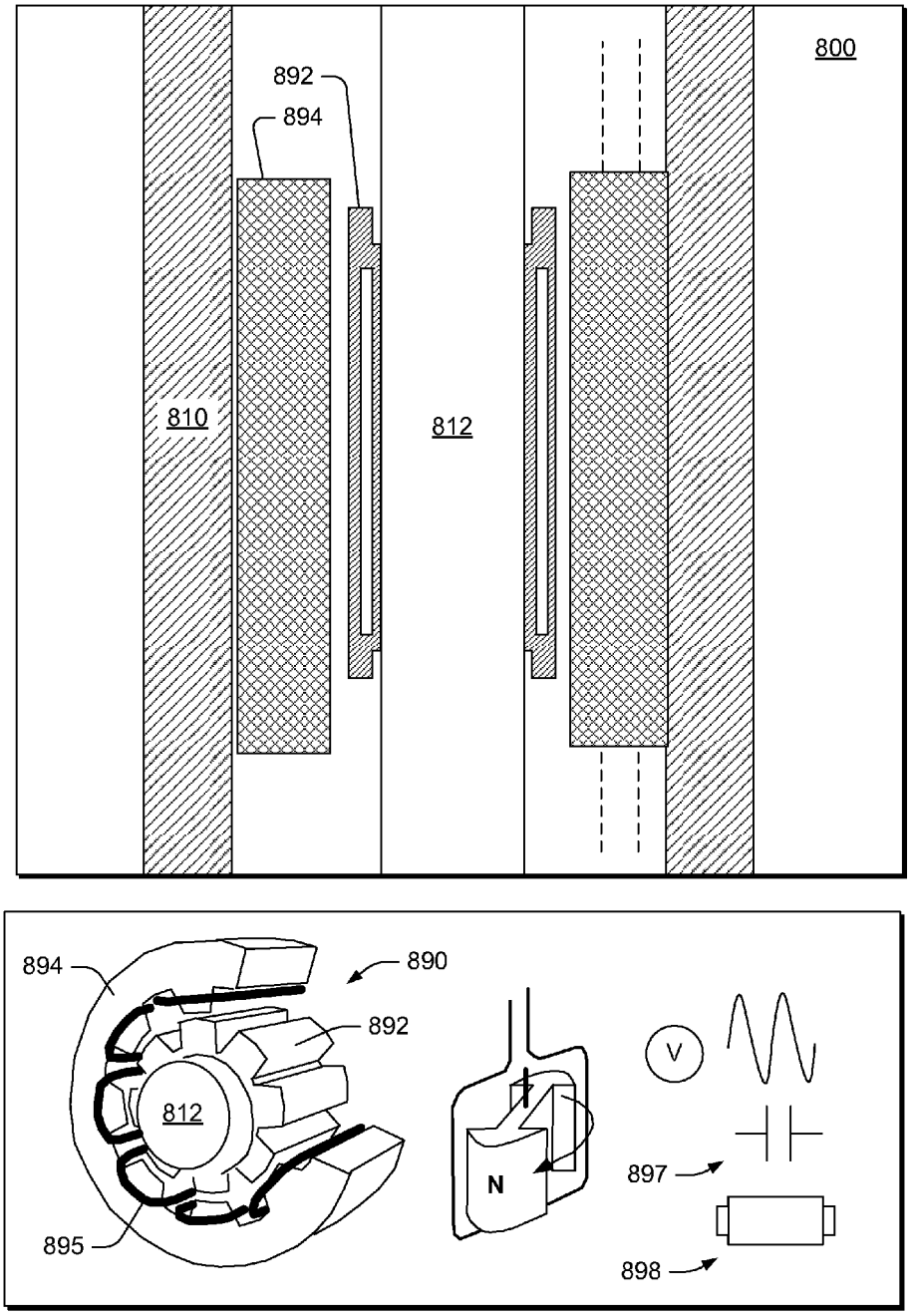
FIG. 8 illustrates an example of a system that includes a power generator.

FIG. 8 shows an example of a system 800 that includes a power unit 890 that includes a rotor 892 and a stator 894 with coils 895. As shown, the power unit 890 may couples to a shaft 812. As shown, the shaft 812 may be associated with a housing 810. As indicated, rotation of the rotor 892, which may include magnets, may generate fields in the stator 894 that can drive current in the coils 895, which may provide a voltage. As an example, circuitry may provide for filtering, rectifying, etc. of the output of the coils 895. As an example, capacitor-based circuitry 897 and/or a battery 898 may provide for power storage.

As an example, a remote unit that includes a sensor may also include a generation module. For example, a remote unit may include circuitry, components, etc. of a power unit such as, for example, the power unit 890.

Figure 9:
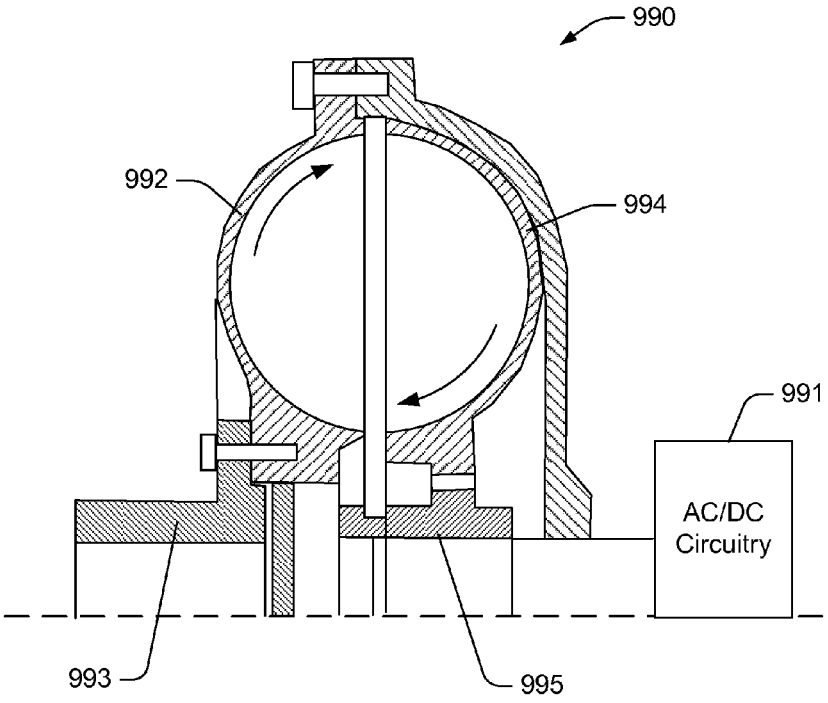
FIG. 9 illustrates an example of a power generator.

FIG. 9 shows an example of a power unit 990 configured to generate power using AC and/or DC circuitry 991 from kinetic energy provided via fluid coupling. In such an example, the power unit 990 may be connected to a shaft 995 with an intermediate fluid coupling that is driven by kinetic energy provided by another shaft 993 (e.g., consider an hydraulically coupled transmission of an automobile that couples an engine shaft to a shaft that can drive wheels). As an example, the shaft 993 may be part of a pump shaft or other shaft portion of an ESP. As an example, a power unit or power generation module may be or include a kinetic energy recovery system (KERS). As an example, a fluid coupling may act to smoothen starting/transitional speed changes and to facilitate connection of a KERS (e.g., to smooth action of an ESP shaft with respect to a KERS-based power generation module).

In the example of FIG. 9, the power unit 900 includes an impeller 992 and a runner 994, which may provide for transmitting rotation between shafts 993 and 995, respectively, by means of acceleration and deceleration of a fluid (e.g., oil or other fluid) that forms a fluid coupling (e.g., the impeller 992, the runner 994 and fluid form a fluid coupling). As shown, the fluidly coupled shaft 995 may interact with the AC/DC circuitry 991 for purposes of power generation.

As an example, a fluid coupling can include two toroids in a sealed shell of fluid (e.g., substantially incompressible fluid) where one of the toroids is attached to a driving shaft and spins with rotational force such that the spinning toroid moves the fluid around the receiving toroid. In such an example, movement of the fluid can turn the receiving toroid and thus turn the connected shaft.

As an example, a power unit or power generation module may include a fluid coupling, for example, as a hydrodynamic device to transmit rotating mechanical power to drive a generator (e.g., coupled to a driven shaft). As an example, a fluid coupling may provide for variable speed operation and/or controlled start-up with reduced shock loading.

As an example, an electric submersible pump system can include a shaft; a power cable connector; an electric motor configured to receive power via the power cable connector for rotatably driving the shaft; a pump operatively coupled to the shaft; a power unit for generating power via rotation of the shaft; a remote unit that includes at least one sensor for sensing information, wireless transmission circuitry for wireless transmission of sensed information and a power interface to receive power generated by the power unit; and a base unit that includes wireless reception circuitry for receipt of wireless transmission of sensed information from the remote unit and wired transmission circuitry operatively coupled to the power cable connector. Such a system may include one or more additional remote units, for example, where each remote unit includes at least one sensor for sensing information and wireless transmission circuitry for wireless transmission of sensed information.

As an example, a remote unit may include wireless reception circuitry for wireless receipt of information and wireless transmission circuitry for wireless transmission of sensed information. As an example, a remote unit may include wireless reception circuitry for wireless receipt of information from another remote unit.

As an example, a remote unit can include wireless reception circuitry for wireless receipt of a remote unit control command, for example, where a base unit includes wireless transmission circuitry for wireless transmission of the remote unit control command. As an example, a daisy-chain of remote units may be provided for transmission of a command from a base unit to one of the remote units.

As an example, a system may include multiple sections where each of at least two of the sections includes a remote unit. In such an example, the multiple sections may include multiple pump sections. For example, a system may include multiple pump sections where each pump section includes a remote unit that includes at least one sensor for sensing information, wireless transmission circuitry for wireless transmission of sensed information and a power interface to receive power generated by a power unit, which may optionally be part of the remote unit.

As an example, a power unit can include a stator and a rotor where the rotor is operatively coupled to a shaft of an ESP system. As an example, a power unit can include a fluid coupling for moving fluid where the fluid coupling is operatively coupled to a shaft of an ESP system.

As an example, an ESP system may include a power storage device operatively coupled to at least a power interface of a remote unit. In such an example, the power storage device may be operatively coupled to a power unit. As an example, a power storage device may be or include one or more of a battery, a capacitor and a kinetic energy storage device.

As an example, an ESP system may include an electric motor that is a multiphase motor with a wye point where a base unit includes power reception circuitry operatively coupled to the wye point. In such an example, wired transmission circuitry of the base unit (e.g., wired communication circuitry) may be operatively coupled to a power cable connector via the wye point (e.g., for transmission and/or receipt of information via one or more conductors of the power cable).

As an example, an ESP system may be arranged as a string where a base unit is positioned at an end of the string and where the base unit is operatively coupled to an end of an electric motor. In such an example, a remote unit may be positioned at least in part within a pump housing of a pump of the ESP system. As an example, a remote unit may include a sensor for sensing information associated with a pump intake or a sensor for sensing information associated with a pump discharge.

As an example, a shaft of an ESP system may include multiple portions and a power unit may include a coupling for coupling a first portion of the shaft to a second portion of the shaft.

As an example, a method can include providing an electric submersible pump system that includes a shaft, a power cable connector, an electric motor configured to receive power via the power cable connector for rotatably driving the shaft, a pump operatively coupled to the shaft, a power unit for generating power via rotation of the shaft, a remote unit that includes at least one sensor for sensing information, wireless transmission circuitry for wireless transmission of sensed information and a power interface to receive power generated by the power unit, and a base unit that includes wireless reception circuitry for receipt of wireless transmission of sensed information from the remote unit and wired transmission circuitry operatively coupled to the power cable connector; sensing information using the at least one sensor of the remote unit; transmitting the sensed information via the wireless transmission circuitry; and receiving the sensed information via the wireless reception circuitry. As an example, such a method may include transmitting information based at least in part on the sensed information via the wired transmission circuitry.

As an example, one or more methods described herein may include associated computer-readable storage media (CRM) blocks. Such blocks can include instructions suitable for execution by one or more processors (or cores) to instruct a computing device or system to perform one or more actions. As an example, a computer-readable storage medium may not be a carrier wave (e.g., it may be a physical storage device).

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 10:
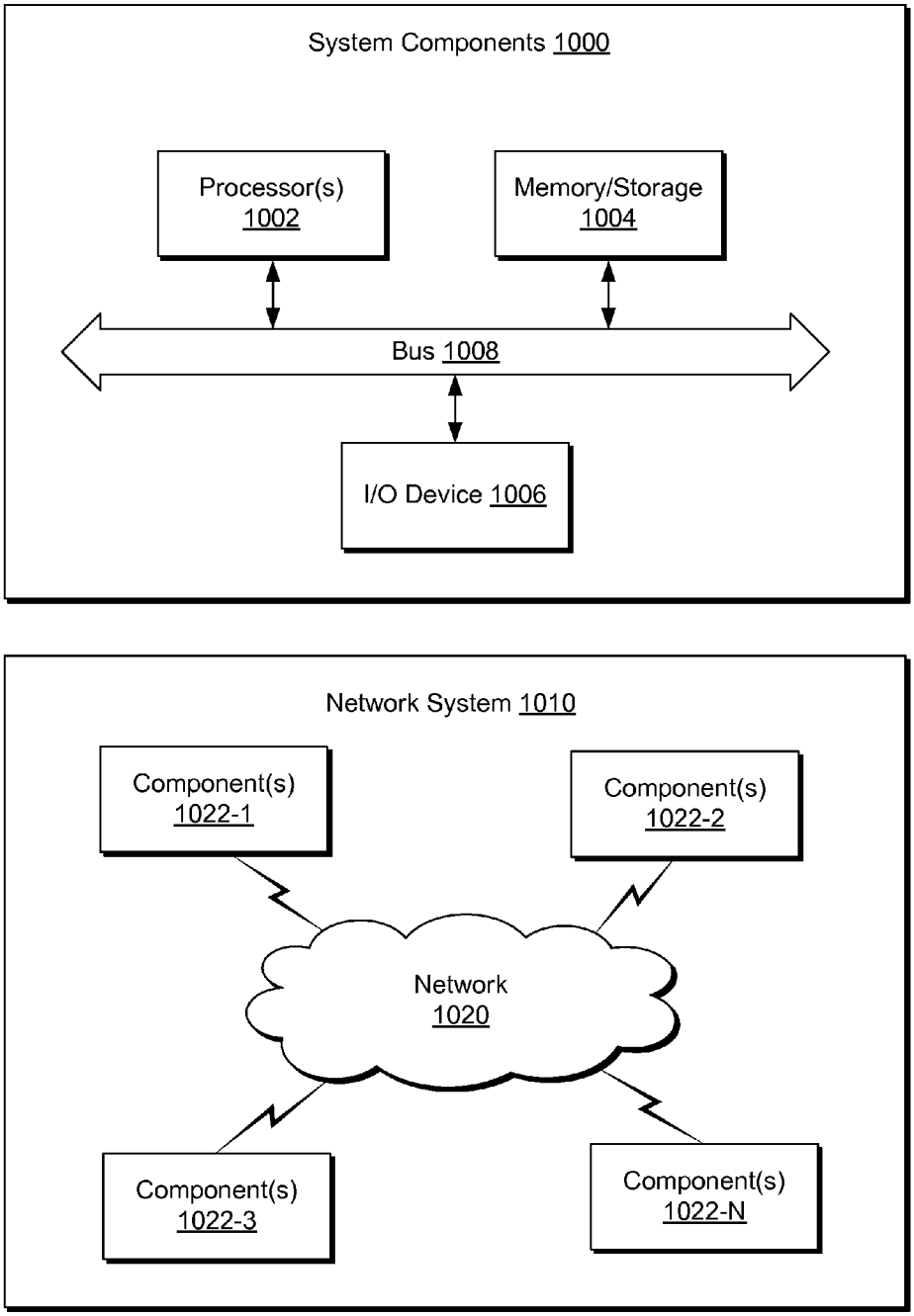
FIG. 10 illustrates example components of a system and a networked system.

FIG. 10 shows components of a computing system 1000 and a networked system 1010. The system 1000 includes one or more processors 1002, memory and/or storage components 1004, one or more input and/or output devices 1006 and a bus 1008. According to an embodiment, instructions may be stored in one or more computer-readable media (e.g., memory/storage components 1004). Such instructions may be read by one or more processors (e.g., the processor(s) 1002) via a communication bus (e.g., the bus 1008), which may be wired or wireless. The one or more processors may execute such instructions to implement (wholly or in part) one or more attributes (e.g., as part of a method). A user may view output from and interact with a process via an I/O device (e.g., the device 1006). According to an embodiment, a computer-readable medium may be a storage component such as a physical memory storage device, for example, a chip, a chip on a package, a memory card, etc.

According to an embodiment, components may be distributed, such as in the network system 1010. The network system 1010 includes components 1022-1, 1022-2, 1022-3, . . . 1022-N. For example, the components 1022-1 may include the processor(s) 1002 while the component(s) 1022-3 may include memory accessible by the processor(s) 1002. Further, the component(s) 1002-2 may include an I/O device for display and optionally interaction with a method. The network may be or include the Internet, an intranet, a cellular network, a satellite network, etc.

Conclusion

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words "means for" together with an associated function.

What is claimed is:

1. An electric submersible pump system comprising:
- a shaft;
- a power cable connector;
- an electric motor configured to receive power via the power cable connector for rotatably driving the shaft;
- a pump operatively coupled to the shaft;
- a power unit for generating power via rotation of the shaft;
- a remote unit that comprises at least one sensor for sensing information, wireless transmission circuitry for wireless transmission of sensed information and a power interface to receive power generated by the power unit; and
- a base unit that comprises wireless reception circuitry for receipt of wireless transmission of sensed information from the remote unit and wired transmission circuitry operatively coupled to the power cable connector.

2. The electric submersible pump system of claim 1 further comprising another remote unit that comprises at least one sensor for sensing information and wireless transmission circuitry for wireless transmission of sensed information.

3. The electric submersible pump system of claim 1 wherein the remote unit comprises wireless reception circuitry for wireless receipt of information.

4. The electric submersible pump system of claim 2 wherein the remote unit comprises wireless reception circuitry for wireless receipt of information from the other remote unit.

5. The electric submersible pump system of claim 1 wherein the remote unit comprises wireless reception circuitry for wireless receipt of a remote unit control command wherein the base unit comprises wireless transmission circuitry for wireless transmission of the remote unit control command.

6. The electric submersible pump system of claim 1 wherein the power unit comprises a stator and a rotor wherein the rotor is operatively coupled to the shaft.

7. The electric submersible pump system of claim 1 wherein the power unit comprises a fluid coupling for moving fluid wherein the fluid coupling is operatively coupled to the shaft.

8. The electric submersible pump system of claim 1 further comprising a power storage device operatively coupled to at least the power interface of the remote unit.

9. The electric submersible pump system of claim 8 wherein the power storage device is operatively coupled to the power unit.

10. The electric submersible pump system of claim 8 wherein the power storage device comprises a member selected from a group consisting of a battery, a capacitor and a kinetic energy storage device.

11. The electric submersible pump system of claim 1 wherein the base unit comprises at least one sensor.

12. The electric submersible pump system of claim 1 wherein the electric motor comprises a multiphase motor and a wye point and wherein the base unit comprises power reception circuitry operatively coupled to the wye point.

13. The electric submersible pump system of claim 12 wherein the wired transmission circuitry of the base unit is operatively coupled to the power cable connector via the wye point.

14. The electric submersible pump system of claim 1 comprising a string wherein the base unit is positioned at an end of the string and wherein the base unit is operatively coupled to an end of the electric motor.

15. The electric submersible pump system of claim 14 wherein the remote unit is positioned at least in part within a pump housing of the pump.

16. The electric submersible pump system of claim 15 wherein the at least one sensor of the remote unit comprises a sensor for sensing information associated with a pump intake.

17. The electric submersible pump system of claim 15 wherein the at least one sensor of the remote unit comprises a sensor for sensing information associated with a pump discharge.

18. The electric submersible pump system of claim 1 comprising multiple pump sections wherein each of the pump sections comprises a remote unit that comprises at least one sensor for sensing information, wireless transmission circuitry for wireless transmission of sensed information and a power interface to receive power.

19. A method comprising:

providing an electric submersible pump system that comprises a shaft, a power cable connector, an electric motor configured to receive power via the power cable connector for rotatably driving the shaft, a pump operatively coupled to the shaft, a power unit for generating power via rotation of the shaft, a remote unit that comprises at least one sensor for sensing information, wireless transmission circuitry for wireless transmission of sensed information and a power interface to receive power generated by the power unit, and a base unit that comprises wireless reception circuitry for receipt of wireless transmission of sensed information from the remote unit and wired transmission circuitry operatively coupled to the power cable connector;

sensing information using the at least one sensor of the remote unit;

transmitting the sensed information via the wireless transmission circuitry; and receiving the sensed information via the wireless reception circuitry.

20. The method of claim 19 further comprising transmitting information based at least in part on the sensed information via the wired transmission circuitry.

* * * * *